United States Patent [19]

Carroll

[11] Patent Number: 4,860,453

[45] Date of Patent: Aug. 29, 1989

[54] DEBURRING TOOL

[76] Inventor: Joseph J. Carroll, 10141 Rockinghorse La., Redding, Calif. 96003

[21] Appl. No.: 109,483

[22] Filed: Oct. 16, 1987

[51] Int. Cl.[4] ..... B26B 9/00; B23P 15/22

[52] U.S. Cl. ..... 30/347; 15/104.1 R; 29/1.32; 408/157; 408/211

[58] Field of Search ..... 30/169, 347, 276; 15/104.1 R, 104.04, 104.13; 29/1.32; 408/82, 211, 153, 156, 157, 223, 1, 225, 227; 269/97

[56] References Cited

U.S. PATENT DOCUMENTS

| | | | |
|---|---|---|---|
| 687,512 | 11/1901 | Barker et al. | 408/157 |
| 1,228,951 | 6/1917 | Morton | 408/227 |
| 1,946,869 | 2/1934 | Miller | 407/33 X |
| 2,278,631 | 4/1942 | Young | 408/157 |
| 2,869,406 | 1/1959 | Belmont | 408/211 X |
| 3,232,145 | 2/1966 | Wilson | 408/202 |
| 3,365,773 | 1/1968 | Olson | 408/232 |
| 3,818,563 | 6/1974 | Beaulieu | 29/1.32 |
| 3,824,646 | 7/1974 | Jai | 15/104.2 X |
| 3,870,432 | 3/1975 | Strybel | 408/191 |
| 3,990,806 | 11/1976 | Meyers | 408/211 |
| 4,178,189 | 12/1979 | Mancini et al. | 29/1.3 X |
| 4,413,937 | 11/1983 | Gutsche | 408/239 R X |
| 4,468,829 | 9/1984 | Christensen | 15/104.04 X |
| 4,653,157 | 3/1987 | Alexander | 29/1.32 |
| 4,686,751 | 8/1987 | Gracey | 29/1.32 |

FOREIGN PATENT DOCUMENTS

| | | | |
|---|---|---|---|
| 2518187 | 4/1975 | Fed. Rep. of Germany | 408/211 |
| 2658344 | 6/1978 | Fed. Rep. of Germany | 408/211 |

*Primary Examiner*—Eugene R. LaRoche
*Assistant Examiner*—Seung Ham
*Attorney, Agent, or Firm*—Leonard D. Schappert

[57] ABSTRACT

A deburring tool is provided having two sets of blades for use in simultaneously deburring the inner and outer edges of a piece of tubing, further including adjustment capability allowing the use of the tool in deburring tubing of different sizes, further including a cap recess cleaning tool, a cleaning brush and a base for mounting the deburring tool on a bench, table or the like.

7 Claims, 2 Drawing Sheets

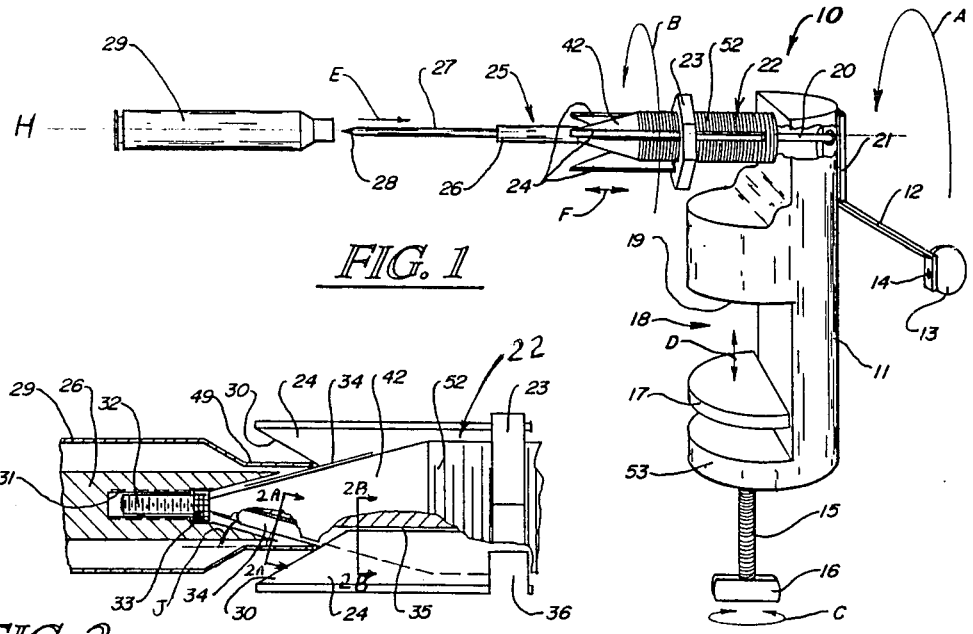
FIG. 1
FIG. 2
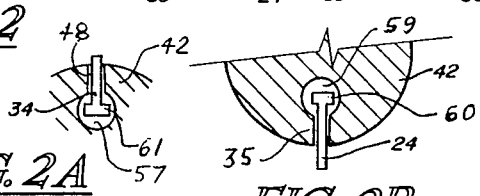
FIG. 2A
FIG. 2B
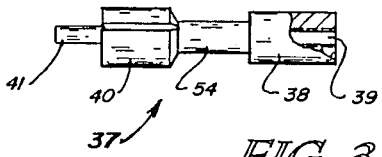
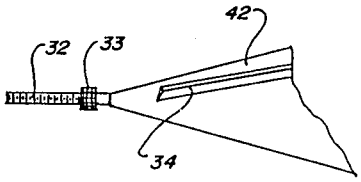
FIG. 3
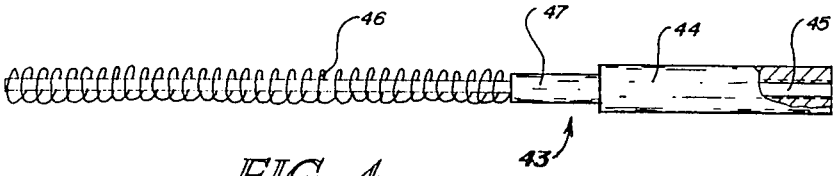
FIG. 4

DEBURRING TOOL

BACKGROUND OF THE INVENTION

1. Field of the Invention. The present invention relates generally to deburring tools, more specifically to deburring tools capable of deburring the outer edge and the inner edge of a cylindrically shaped object, and more particularly to deburring tools which can be utilized to deburr the inner and outer edges of hollow tubing such as a cartridge shell.

2. Description of the Prior Art. Previous inventors have directed their efforts toward providing reaming and deburring tools some of which use angular deburring tools, some of which are known as chasers and reamers, hand reamers, tube working tools for deburring the ends of tubes, and special manual reamers for thin-wall tubing. While each of the tools just mentioned includes angled reaming devices, each of the tools is either quite limited in its use or so complex as to make use by a layperson difficult. None of the prior art of which applicant is aware has taught a deburring tool having the unique features, capabilities and construction of the present invention which allow its use in deburring simultaneously both the inner and the outer edges of the end of hollow tubing such as that used in cartridge shells.

SUMMARY OF THE INVENTION

The present invention consists of a double deburring tool which can be used in simultaneously deburring the inner and outer edges of a cartridge shell, including a cleaning device for cleaning the cap recess of the cartridge shell and the firing hole through which the cap ignites powder in the cartridge shell, and further including means for cleaning the interior of the cartridge shell. The device in one embodiment includes a base which can be clamped to a bench and a rotatable head having blades properly positioned so that, as the rotatable head is turned, the blades deburr the inner and outer edges of a properly positioned cartridge shell. The device further includes adjusting means whereby the deburring tool can be adjusted to deburr simultaneously the inner and outer edges of tubing and/or cartridge shells of different sizes.

One of the objects of the present invention is to provide a deburring tool capable of simultaneously deburring the inner and outer edges of hollow tubing such as a cartridge shell or the like.

Another object of the present invention is to provide a deburring tool having an adjustment capability to allow its use in deburring the inner and outer edges of tubing of different sizes by adjustment of the deburring tool.

A further object of the present invention is to provide a deburring tool specifically for use in deburring cartridge shells for reloading purposes.

Another object of the present invention is to provide a deburring tool which includes an adaptor capable of cleaning out the cap recess of a cartridge shell.

A further object of the present invention is to provide a deburring tool which includes an adaptor for cleaning the interior of tubing and/or cartridge shells.

Another object of the present invention is to provide a versatile deburring tool which can be constructed to be portable in nature and adapted to a multitude of circumstances.

The foregoing objects, as well as other objects and benefits of the present invention, are made more apparent by the descriptions and claims which follow.

BRIEF DESCRIPTION OF THE DRAWINGS

FIG. 1 is a perspective view showing the construction of the deburring tool showing it in position to deburr the end of a cartridge shell.

FIG. 2 is an expanded section view showing the specific structure of the section of the deburring tool utilized in deburring the cartridge shell or hollow tubing.

FIG. 2A is a cross-sectional view taken along lines 2A—2A of FIG. 2 showing the construction of the inner deburring blade.

FIG. 2B is a cross-sectional view taken along lines 2B—2B of FIG. 2 showing the construction of the outer deburring blade.

FIG. 3 is an assembly view showing the adaptor utilized for cleaning a cap recess positioned on the end of the deburring tool.

FIG. 4 is a side view showing a brush which is adaptable for use with the deburring tool in cleaning the interior of a piece of tubing or cartridge shell.

DESCRIPTION OF THE PREFERRED EMBODIMENT

Figure 5:
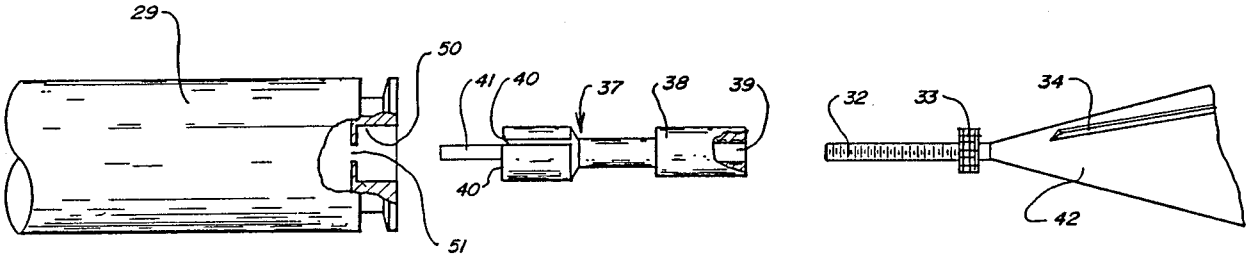
FIG. 5 is an assembly view showing the structure and use of the adaptor for cleaning the cap recess of a cartridge shell.

FIG. 1 of the drawings is a perspective view showing the deburring tool 10 positioned to deburr the end of a cartridge shell 29. The deburring tool 10 has a base 11 together with a deburring cone 22. Base 11 is provided with a clamp consisting of a relieved section 18 with a rigidly positioned jaw 19 at one end and an adjustable jaw 17 positioned at the other end. Adjustable jaw 17 is attached to threaded rod 15, and threaded rod 15 extends through a threaded hole in wall 53 so that, as threaded rod 15 is turned, adjustable jaw 17 moves toward or away from jaw 19 along arrow D. Threaded rod 15 has a handle 16 enabling it to be turned easily as shown by arrow C. Deburring cone 22 includes a rod 20 which is substantially rigidly attached thereto. Rod 20 passes through a hole 21 in base 11 as shown and attaches to arm 12 by means of a screw or other appropriate attaching means. Arm 12 has a handle 13 pivotally attached thereto by means of a screw or pin 14. When arm 12 is turned along arrow A, deburring cone 22 turns on axis H as shown by arrow B. Deburring cone 22 includes a cone 42 and multiple outer blades 24, as well as multiple inner blades 34 shown in other views of the drawings. The inner blades 34 are not generally adjustable, but the outer blades 24 are captured in slots within deburring tool 22 and by means of slots in outer blades 24 into which nut 23 fits so that, as nut 23 is turned on threads 52 of deburring cone 22, the outer blades 24 move back and forth along arrow F, thereby changing the point at which they intersect cone 42 of deburring cone 22. For purposes of utilizing deburring cone 22 with deburring tool 10 to deburr a cartridge shell 29 as shown, a positioning tool 25 is provided which consists of a base 26 with an extension 27 attached thereto. Extension 27 has a point 28 positioned thereon so that, as extension 27 is pushed inside of cartridge shell 29 and positioned properly, it will extend through the igniting hole 51 of cartridge shell 29. Deburring cone 22, rod 20 and positioning tool 25 are all substantially concentrically located on axis H so that they turn on axis H.

FIG. 2 of the drawings is an expanded sectional view utilizing a cutaway view of cone 42 of deburring cone 22, together with a cross-sectional view of cartridge shell 29 and base 26 of positioning tool 25. Deburring cone 22 has slots 35 into which blades 24 fit. While only one slot 35 is shown in the cutaway of FIG. 2, such slots are provided for each of the outer blades 24. The method of capturing outer blades 24 in slots 35 is shown in FIG. 2B of the drawings. Outer blades 24 also have slots 36 cut therein so that, if outer blades 24 are positioned in slots 35 of deburring cone 22, threaded nut 23 is positioned so that it captures outer blades 24 in slots 36. Inner blades 34 are also positioned in cone 42 of deburring cone 22 in slots as shown in FIG. 2A of the drawings. Deburring cone 22 further includes a threaded extension 32 at the end of cone 42 and a nut 33. Base 26 of positioning tool 25 has a threaded hole 31 in the end thereof whereby positioning tool 25 is attached to threaded extension 32 of deburring cone 22. The diameter of base 26 of positioning tool 25 is such that it approximates the inner diameter of the end of cartridge shell 29 so that it tends to hold the shell casing in position during deburring. The angles of the cutting edge 30 of outer blades 24 and the cutting edge of inner blades 34 are set to deburr the inner and outer edges of cartridge shell 29 simultaneously. Nut 23 is adjusted to position outer blades 24 against the outer edge of cartridge shell 29 when cartridge shell 29 is pushed in until it contacts inner blades 34. The angle I of cutting edge 30 of blade 24 to the wall of cartridge shell 29 was set at substantially 35 degrees in this embodiment, but any angle sufficient to facilitate deburring of the outer edge of the wall of cartridge shell 29 could be used. The angle J of the cutting edge of blade 34 to the wall of cartridge shell 29 was set at substantially 25 degrees in this embodiment, but any angle sufficient to facilitate deburring of the inner edge of the wall of cartridge shell 29 could be used.

FIG. 2A is a cross-sectional view of cone 42 taken along lines 2A—2A of FIG. 2 showing an inner blade 34 positioned in slot 48 of cone 42. There is an expanded opening 57 at the edge of slot 48 which facilitates insertion of an inner blade 34 with an expanded edge 61. Expanded edge 61 is provided to capture inner blade 34 in slot 48.

FIG. 2B is a cross-sectional view of cone 42 taken along lines 2B—2B of FIG. 2 showing an outer blade 24 positioned in slot 35 of cone 42. There is an expanded opening 59 at the edge of slot 35 which facilitates insertion of outer blade 24 with an expanded edge 60. Expanded edge 60 is provided to capture outer blade 24 in slot 35.

Expanded edges 60 and 61 of outer blade 24 and inner blade 34 respectively are created by pressure applied to the edges of the blades 24 and 34 until they expand or by any other acceptable method of providing an expanded edge.

FIG. 3 of the drawings shows cone 42 of deburring cone 22 together with threaded extension 32 and nut 33. Further shown is a cap recess cleaning tool 37 having a center section 54 with an enlarged section 38 at one end and cleaning blades 40 at the opposite end. An extension 41 which fits inside of igniting hole 51 of a cartridge shell 29 is provided at the end of cleaning blades 40. Cap recess cleaning tool 37 has a threaded hole 37 so that it can be screwed onto threaded extension 32 of deburring tool 22. Once in position, extension 41 may be inserted into igniting hole 51 of a cartridge shell 29. Once in position, blades 40 of cap recess cleaning tool 37 clean the inside of the cap recess when cap recess cleaning tool 37 is turned.

FIG. 4 is a side view showing a brush unit 43 for cleaning the interior of a cartridge shell 29. It includes a base 44 having a threaded hole 45 so that it can be screwed onto extension 32 of deburring cone 22 and an extension 47 to which a brush 46 is attached. When cleaning brush 43 is attached to the threaded extension 32 of deburring tool 22 and handle 13 is turned, brush 46 turns, thereby cleaning the interior of cartridge shell 29 in which it is positioned.

FIG. 5 is an assembly view showing the use of cap recess cleaning tool 37 to clean a cap recess 50 in cartridge shell 29. Extension 41 of cap recess cleaning tool 37 extends through igniting hole 51 of cartridge shell 29, thereby cleaning igniting hole 51 and centering cap recess cleaning tool 37 so that, when cap recess cleaning tool 37 is turned, the blades 40 clean out cap recess 50. Cap recess cleaning tool 37 includes a threaded hole 39 designed to facilitate attachment to threaded extension 32 of deburring cone 22.

Figure 6:
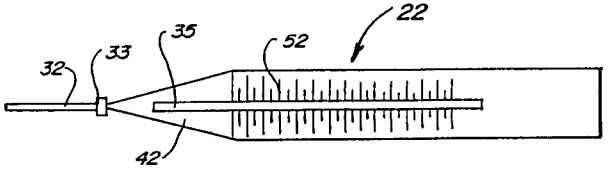
FIG. 6 is a side view showing the structure of the deburring tool.

FIG. 6 of the drawings is a top view of the body of deburring cone 22 without any blades positioned therein. Slot 35, into which outer blade 24 extends from cone 42 of deburring cone 22, extends well into threads 52 of deburring cone 22. Threaded extension 32 is substantially rigidly attached to cone 42, and a nut 33 is provided to act as a stop for holding positioning tools and other tools on the end of deburring cone 22 as well as preventing inner blades 34 from coming out of slots 48.

Figure 7:
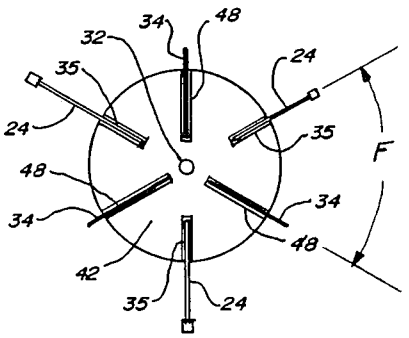
FIG. 7 is an end view of the deburring tool cone showing the positioning of the blades involved in deburring the outer edge and the blades involved in deburring the inner edge of a shell or piece of tubing simultaneously.

FIG. 7 of the drawings is an end view of the cone 42 of deburring cone 22. FIG. 7 particularly shows the positioning of inner blades 34, which deburr the inside edge of a cartridge shell 29, and the positioning of outer blades 24, which deburr the outer edge of a cartridge shell 29, during use. FIG. 7 further shows the layout of slots 48 utilized to hold inner blades 34 in position and slots 35 utilized to capture outer blades 24. Nut 33 is also utilized to hold blades 34 in position as shown in FIGS. 2 and 5 of the drawings. The outer blades 24 are positioned about axis H and threaded extension 32, which is positioned on axis H at substantially 120 degrees from each other, and inner blades 34 are positioned about axis H and threaded extension 32, which is positioned on axis H at substantially 120-degree intervals. All of the blades utilized are positioned substantially equiangularly about axis H so that, when six blades are used as in this embodiment, a blade of one sort or the other is positioned at substantially every 60 degrees about the axis H established by threaded extension 32.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A deburring tool for simultaneously deburring an inner edge and an outer edge of a wall of hollow tubing, comprising:

a substantially cylindrically shaped body having:

a first end;

a second end;

an axis substantially concentrically located extending from said first end to said second end;

a cone positioned at said first end, and at least four slots extending lengthwise from said cone toward said second end positioned substantially equiangularly about said axis of said substantially cylindrically shaped body;

at least two inner blades, each having a cutting edge and positioned in said slots near said cone and substantially equiangularly about said axis, each of said inner blades being oriented so that said cutting edge is directed away from said axis and positioned at an angle which facilitates efficient deburring of said inner edge of said wall of said tubing;

first capturing means for capturing said inner blades in said slots;

at least two outer blades, each having a cutting edge, positioned in said slots near said cone and substantially equiangularly about said axis, each of said outer blades being oriented so that said cutting edge is directed toward said axis and positioned at an angle which facilitates efficient deburring of said outer edge of said wall of said tubing;

second capturing means for capturing said outer blades in said slots;

a substantially concentrically located first attaching means substantially rigidly attached to and extending outward from said cone along said axis whereby auxiliary tools are attached to said deburring tool, and a cap recess cleaning tool having blades for cleaning a cap recess of a cartridge shell and having third attaching means whereby said cap recess cleaning tool attaches to said first attaching means.

2. A deburring tool for simultaneously deburring an inner edge and an outer edge of a wall of hollow tubing, comprising:

a substantially cylindrically shaped body having:

a first end;

a second end;

an axis substantially concentrically located extending from said first end to said second end;

a cone positioned at said first end, and at least four slots extending lengthwise from said cone toward said second end positioned substantially equiangularly about said axis of said substantially cylindrically shaped body;

at least two inner blades, each having a cutting edge and positioned in said slots near said cone and substantially equiangularly about said axis, each of said inner blades being oriented so that said cutting edge is directed away from said axis and positioned at an angle which facilitates efficient deburring of said inner edge of said wall of said tubing;

first capturing means for capturing said inner blades in said slots;

at least two outer blades, each having a cutting edge, positioned in said slots near said cone and substantially equiangularly about said axis, each of said outer blades being oriented so that said cutting edge is directed toward said axis and positioned at an angle which facilitates efficient deburring of said outer edge of said wall of said tubing;

second capturing means for capturing said outer blades in said slots;

a substantially concentrically located first attaching means substantially rigidly attached to and extending outward from said cone along said axis whereby auxiliary tools are attached to said deburring tool, and a brush for cleaning the inside of said tubing having fourth attaching means whereby said brush attaches to said first attaching means.

3. A deburring tool for simultaneously deburring an inner edge and an outer edge of a wall of hollow tubing, comprising:

a substantially cylindrically shaped body having:

a first end;

a second end;

an axis substantially concentrically located extending from said first end to said second end;

a cone positioned at said first end, and at least four slots extending lengthwise from said cone toward said second end positioned substantially equiangularly about said axis of said substantially cylindrically shaped body;

at least two inner blades, each having a cutting edge and positioned in said slots near said cone and substantially equiangularly about said axis, each of said inner blades being oriented so that said cutting edge is directed away from said axis and positioned at an angle which facilitates efficient deburring of said inner edge of said wall of said tubing;

first capturing means for capturing said inner blades in said slots, consisting substantially of an expanded edge on each of said inner blades and an expanded opening in said slot into which said expanded edge of said inner blade fits;

at least two outer blades, each having a cutting edge, positioned in said slots near said cone and substantially equiangularly about said axis, each of said outer blades being oriented so that said cutting edge is directed toward said axis and positioned at an angle which facilitates efficient deburring of said outer edge of said wall of said tubing;

second capturing means for capturing said outer blades in said slots, consisting substantially of an expanded edge on each of said outer blades and an expanded opening in said slot into which said expanded edge of said outer blade fits, and a substantially concentrically located first attaching means substantially rigidly attached to and extending outward from said cone along said axis whereby auxiliary tools are attached to said deburring tool.

4. The invention of claim 3, including adjusting means for adjusting the lateral position of said outer blades with respect to said first end of said substantially cylindrically shaped body whereby the point at which said outer blades intersect with said inner blades can be adjusted, thereby facilitating deburring of tubing of different diameters.

5. The invention of claim 4, wherein each of said outer blades has a slot therein, said substantially cylindrically shaped body has threads extending from said cone toward said second end and said adjusting means consists substantially of a threaded nut, threaded onto said threads of said substantially cylindrically shaped body and positioned in said slots of said outer blades, thereby adjusting the lateral position of said outer blades when said nut is turned.

6. The invention of claim 3, including a positioning tool having second attaching means whereby said positioning tool attaches to said first attaching means to facilitate centering said hollow tubing.

7. The invention of claim 3, including a base having a second attaching means for attaching said base to a surface, a third attaching means for rotatably attaching said deburring tool to said base and a handle operationally attached to said deburring tool so that, when said handle is turned, said deburring tool turns with respect to said base.

* * * * *